US010240774B2

(12) United States Patent
Hrinda et al.

(10) Patent No.: US 10,240,774 B2
(45) Date of Patent: Mar. 26, 2019

(54) METHOD AND APPARATUS FOR HEATING AND PURIFYING LIQUIDS

(71) Applicant: US INTERCORP LLC, Cranford, NJ (US)

(72) Inventors: Radovan Hrinda, Clark, NJ (US); Douglas S. Hirsh, Skaneateles, NY (US)

(73) Assignee: US INTERCORP LLC, Cranford, NJ (US)

( * ) Notice: Subject to any disclaimer, the term of this patent is extended or adjusted under 35 U.S.C. 154(b) by 0 days.

(21) Appl. No.: 15/591,478

(22) Filed: May 10, 2017

(65) Prior Publication Data

US 2017/0248304 A1 Aug. 31, 2017

Related U.S. Application Data

(63) Continuation of application No. 15/405,660, filed on Jan. 13, 2017, now abandoned, which is a continuation-in-part of application No. 14/204,042, filed on Mar. 11, 2014, now abandoned.

(51) Int. Cl.
*F22B 3/06* (2006.01)
*F24V 40/00* (2018.01)

(52) U.S. Cl.
CPC ..... *F22B 3/06* (2013.01); *F24V 40/00* (2018.05)

(58) Field of Classification Search
CPC ..... F22B 3/06; F24J 3/003; F24J 3/00
USPC ..... 122/26; 126/247
See application file for complete search history.

(56) References Cited

U.S. PATENT DOCUMENTS

| | | | | |
|---|---|---|---|---|
| 2,683,448 | A | 7/1954 | Smith | |
| 3,720,372 | A | 3/1973 | Jacobs | |
| 4,424,797 | A | 1/1984 | Perkins | |
| 4,454,861 | A * | 6/1984 | Grenier | F24V 40/00 126/247 |
| 4,779,575 | A | 10/1988 | Perkins | |
| 5,188,090 | A | 2/1993 | Griggs | |
| 5,279,262 | A * | 1/1994 | Muehleck | F16D 57/00 122/26 |
| 5,385,298 | A | 1/1995 | Griggs | |
| 6,164,274 | A | 12/2000 | Giebeler et al. | |
| 6,227,193 | B1 | 5/2001 | Selivanov | |
| 7,658,335 | B2 * | 2/2010 | Johnson, Jr. | F24D 12/02 122/448.3 |

(Continued)

FOREIGN PATENT DOCUMENTS

| | | |
|---|---|---|
| KR | 10-1036662 | 5/2011 |
| KR | 10-2012-0066697 | 6/2012 |

(Continued)

*Primary Examiner* — Steven B McAllister
*Assistant Examiner* — Ko-Wei Lin
(74) *Attorney, Agent, or Firm* — Clark & Brody

(57) ABSTRACT

A fluid cavitation apparatus includes a housing, an external rotor with cavitation bores in an outer surface thereof, and a motor for rotating the external rotor. An inner surface of the housing is spaced from the outer surface of the external rotor to create a fluid cavitation zone. The inner surface of the housing is configured with a spiral shape and tunnel zone to enhance the thermal transfer characterisitics of the fluid for heating, cooling, and purification. A control system to facilitate proper motor speed, and fluid behavior to enhance the cavitation process.

16 Claims, 6 Drawing Sheets

(56) References Cited

U.S. PATENT DOCUMENTS

| | | | | |
|---|---|---|---|---|
| 7,762,715 | B2 | 7/2010 | Gordon et al. | |
| 7,806,584 | B2 * | 10/2010 | Wootan ..... | A01K 63/042 366/170.3 |
| 8,042,989 | B2 | 10/2011 | Gordon et al. | |
| 8,603,198 | B2 | 12/2013 | Gordon et al. | |
| 2010/0154772 | A1 | 6/2010 | Harris et al. | |

FOREIGN PATENT DOCUMENTS

| | | |
|---|---|---|
| RU | 2262644 | 10/2005 |
| WO | 2012/164322 | 12/2012 |

* cited by examiner

Section I

Section II

TABLE

Water Density ($\rho$), Surface tension ($\gamma$), Viscosity ($\eta$) Specific heat ($c_p$)
As a function of the temperature

| $t$ (°C) | $\rho$ (kg/m³) | $\gamma$ (mN/m) | $\eta$ (mPa s) | $c_p$ (kJ/kg.K) |
|---|---|---|---|---|
| 1 | 999.87 | 75.49 | 1.792 | 4.2141 |
| 2 | 999.93 | 75.34 | 1.731 | 4.2107 |
| 3 | 999.99 | 75.04 | 1.619 | 4.2077 |
| 4 | 1000.00 | 74.89 | 1.567 | 4.2048 |
| 5 | 999.99 | 74.75 | 1.519 | 4.2022 |
| 6 | 999.97 | 74.60 | 1.473 | 4.1999 |
| 7 | 999.93 | 74.45 | 1.428 | 4.1977 |
| 8 | 999.88 | 74.30 | 1.386 | 4.1957 |
| 9 | 999.81 | 74.15 | 1.346 | 4.1939 |
| 10 | 999.73 | 74.01 | 1.308 | 4.1922 |
| 11 | 999.63 | 73.86 | 1.271 | 4.1907 |
| 12 | 999.52 | 73.71 | 1.236 | 4.1893 |
| 13 | 999.40 | 73.56 | 1.203 | 4.1880 |
| 14 | 999.27 | 73.41 | 1.171 | 4.1869 |
| 15 | 999.13 | 73.26 | 1.140 | 4.1858 |
| 16 | 999.13 | 73.12 | 1.111 | 4.1849 |
| 17 | 999.80 | 72.97 | 1.083 | 4.1840 |
| 18 | 998.62 | 72.82 | 1.056 | 4.1832 |
| 19 | 998.43 | 72.67 | 1.030 | 4.1825 |
| 20 | 998.23 | 72.53 | 1.005 | 4.1819 |
| 21 | 998.02 | 72.38 | 0.981 | 4.1813 |
| 22 | 997.80 | 72.23 | 0.958 | 4.1808 |
| 23 | 997.57 | 72.08 | 0.936 | 4.1804 |
| 24 | 997.32 | 71.93 | 0.914 | 4.1800 |
| 25 | 997.07 | 71.78 | 0.894 | 4.1796 |
| 26 | 996.81 | 71.63 | 0.874 | 4.1793 |
| 27 | 996.54 | 71.48 | 0.855 | 4.1790 |
| 28 | 996.26 | 71.33 | 0.836 | 4.1788 |
| 29 | 995.97 | 71.18 | 0.818 | 4.1786 |
| 30 | 995.67 | 71.03 | 0.801 | 4.1785 |
| 35 | 994.06 | 70.29 | 0.723 | 4.1782 |
| 40 | 992.24 | 69.54 | 0.656 | 4.1786 |
| 45 | 990.25 | 68.6 | 0.599 | 4.1795 |
| 50 | 988.07 | 67.8 | 0.549 | 4.1807 |
| 55 | 985.73 | 66.9 | 0.506 | 4.1824 |
| 60 | 983.24 | 66.0 | 0.469 | 4.1844 |
| 65 | 980.59 | 65.1 | 0.436 | 4.1868 |
| 70 | 977.81 | 64.2 | 0.406 | 4.1896 |
| 75 | 974.89 | 63.3 | 0.380 | 4.1928 |
| 80 | 971.83 | 62.3 | 0.357 | 4.1964 |
| 85 | 968.65 | - | 0.336 | 4.2005 |
| 90 | 965.34 | - | 0.317 | 4.2051 |

FIGURE 9

METHOD AND APPARATUS FOR HEATING AND PURIFYING LIQUIDS

This application is a Continuation of U.S. Ser. No. 15/405,660 filed on Jan. 13, 2017, which is a Continuation-in-Part of U.S. Ser. No. 14/204,042 filed on Mar. 11, 2014, which is incorporated in its entirety by reference into this CIP application.

FIELD OF THE INVENTION

The invention relates to a cavitation equipment producing heated or cooled liquids, containing at least one engine, a house, the liquid to be heated, and a cavernous body rotating in the liquid to be heated, and driven by an external engine.

BACKGROUND ART

The phenomenon of cavitation to produce heat in liquids such as water is well known in the art.

An example of a cavitation system using a rotating body for producing heated liquids is presented in U.S. Pat. No. 3,720,372 to Jacobs. Other patented solutions using the cavitation phenomenon to produce heat were developed in 1950s, especially in the United States. A well known patent is U.S. Pat. No. 4,424,797 to Perkins. This patent is a developed and state of the art version of the solutions described in U.S. Pat. No. 2,683,448 to Smith. An improvement was also disclosed in U.S. Pat. No. 4,779,575, also to Perkins.

Cavitational devices are also described in U.S. Pat. Nos. 5,188,090 and 5,385,298 to Griggs. In these devices, a cylindrical body is placed into the housing of the device, and a cloak is provided with cavitational bores. The liquid to be heated is placed into the cylindrical free space between the rotating body with cavitational bores and the internal cloak of the housing; the pressure and temperature of the liquid increases while the cavitational body is rotating. The Griggs patents are incorporated by reference herein in their entirety.

Other cavitation devices are disclosed in U.S. Pat. No. 6,164,274 to Giebeler, U.S. Pat. No. 6,227,193 to Selivanov, and the Russian patent No. RU Z262,644. Another approach from a cavitation standpoint is shown in United States Published Patent Application No. 2010/0154772 to Harris. In this approach, the helical loops of the rotating rotor and the internal cloak of the housing jointly result in cavitational heat production, while the rotor is rotating. The Fabian Patent WO2012/164322A1 teaches a similar cavitation apparatus.

The prior art systems described above have a number of disadvantages, including being inefficient and generating noise, primarily due to these concepts addressing the cavitation process as a two dimensional process. One aim of the invention is to eliminate the disadvantages of the known solutions and the harmful cavitational effects in cavitation devices, to eliminate destructive forces internal to the cavitation process, to improve efficiency, and to reduce cavitation noise through a three dimensional vector approach.

SUMMARY OF THE INVENTION

One object of the invention is a cavitation apparatus producing heated liquids sufficient for fluid purification and alternative methods of heat transfer, containing at least one engine, a housing, liquid to be heated, and one or more cavernous cavitation bodies rotating in the liquid to be heated and driven by the engine. The invention includes the procedure for the operation of the equipment. The solution according to the invention advantageously eliminates the otherwise harmful and eroding features of cavitation, while using the generated cavitation bubbles to change the thermal conditions of liquids, primarily water, for water purification, HVAC applications, and other similar processes that require heat transfer.

More particularly, the invention is characterized in that a constricting form is installed in the housing, the constricting form contains cavitation steps, directional & bounce bumpers, and a free constricting funnel for the liquid to be heated between the constricting form and the cavitation body (2) allowing for velocity and directional control of formed cavitation bubbles critical for process integrity and reduction/elimination of the destructive forces associated with the cavitation process. The method for the use of the cavitation equipment forms also part of the invention, as integral components of the overall cavitation system enhance noise reduction, and process efficiency.

BRIEF DESCRIPTION OF THE DRAWINGS

FIG. 9 shows a table of water physical characteristics that vary over temperature change that require velocity control of cavitation process.

DETAILED DESCRIPTION OF THE INVENTION

Figure 1:
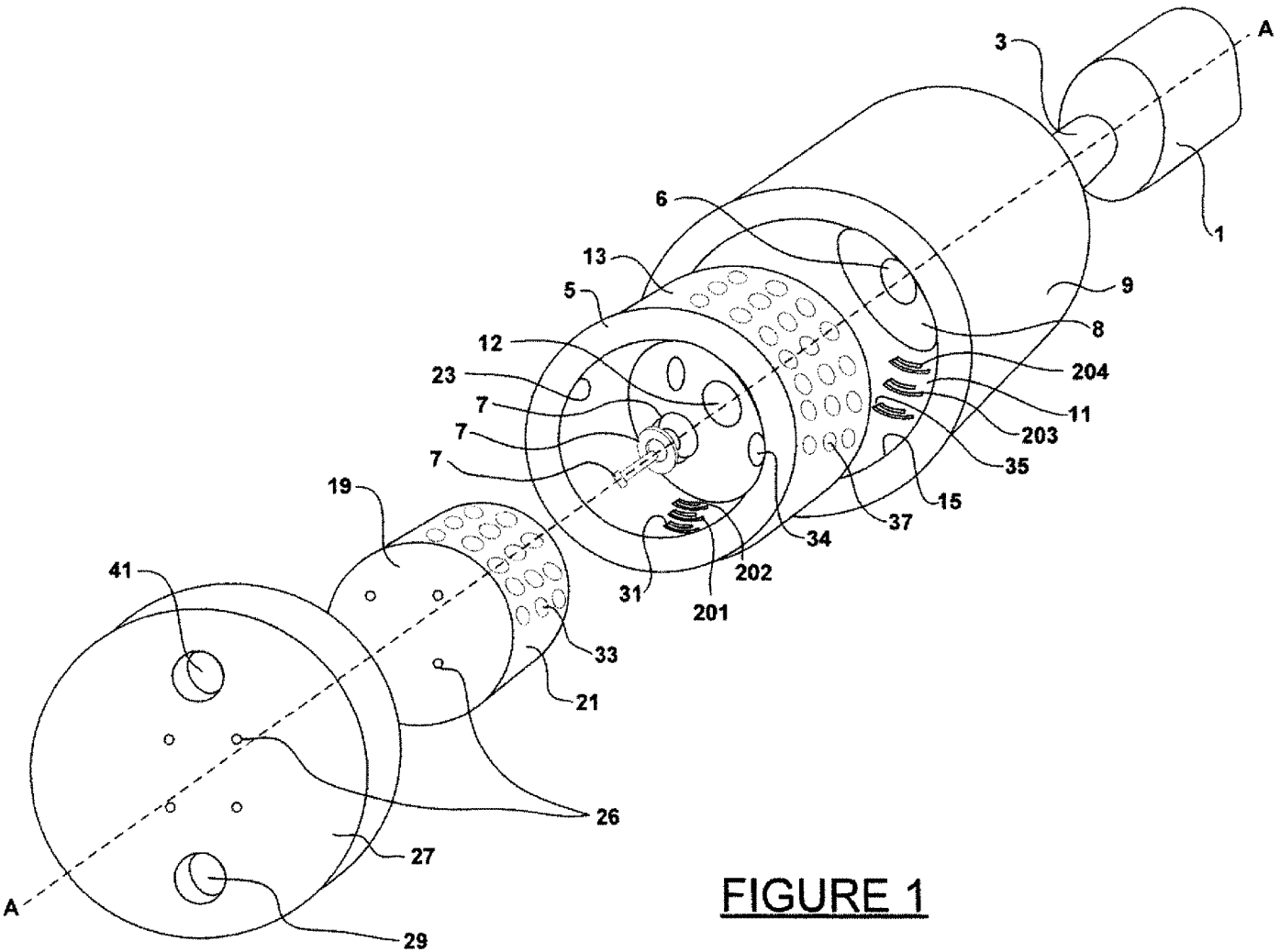
FIG. 1 shows a perspective and exploded view of one embodiment of the invention.
Figure 2:
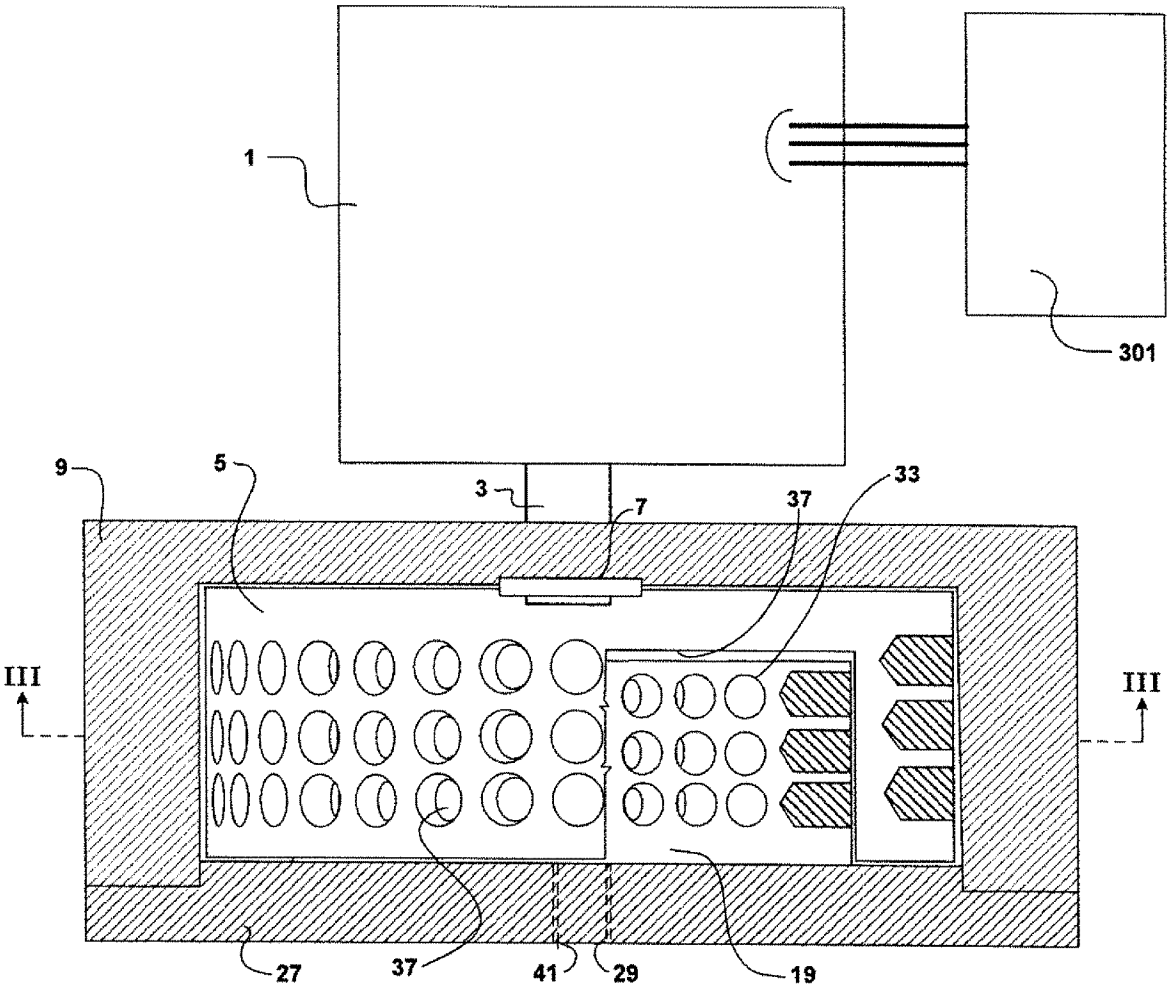
FIG. 2 shows a top of the apparatus of FIG. 1 with portions cut away to show detail.

The phenomenon of cavitation and its use in heating liquids is well known in the prior art.

Cavitational vacuum bubbles are created in the lower pressure parts of liquids, primarily in areas the liquid flows at high speeds. The phenomenon is common in central pumps and in the proximity of ship propellers or water turbines, and may extensively erode the rotating propellers and the surface of all materials affected.

The phenomenon is accompanied by vibration and knocking-like noise; it distorts the flow pattern, and reduces the efficiency of the associated engine. Irrespective of the material the propeller or turbine blade is made of, cavitation erodes the respective surfaces by literally eating away even the hardest alloys and creating tiny holes and cavities on the surface. The name of the phenomenon is of this origin, as cavitation means the creation of cavities. For the above reasons, cavitation is usually a phenomenon to be eliminated.

Cavitational vacuum bubbles are generally small, just a few millimeters in size, and the bubbles are generated by a sudden decrease in pressure in high-speed liquid flows between the molecules of the liquid. The bubbles crash when entering high-pressure areas, or explode and fill the space evenly with drops, if the pressure of high-pressure liquids drops suddenly. Small cavities are created among the drops and drop molecules, creating literally vacuum bubbles. The subsequent crash of such vacuum bubbles is accompanied by a low crashing noise and light emission. The crashing of large quantities of liquid molecules produces cracking, bouncing, and rumbling noise. When the bubbles crash, the energy stored, which is in the form of significant heat and light energy in the bubbles, is released. The energy spreads at various frequencies and is absorbed by neighboring molecules, thereby increasing their temperature. Put another way, the resulting gas reaches a state where the greater temperature and pressure of the saturated gas breaks the molecular adhesion and the bubbles suddenly will split. The resulting high temperature is absorbed by the surrounding fluid molecules, thus heating the fluid. The heat generated during the cavitation process is sufficient to eliminate any bacteria, viral, heavy metal, and other contamination from fluid, thus provided an added benefit of purification. In actuality, a purified fluid is best for controlling the three dimensional cavitation process.

Again, the utilization of this phenomenon to heat liquids has been known for years. However, producing cavitation to heat liquids has been indirectly—e.g. by using rotating bodies run by electric engines—more expensive than heating liquids by using electricity directly. On the other hand, the situation is different, if other economical power sources—e.g. turbine, petrol or diesel engine, etc.—are available anyway. By using such power sources, purified heated liquids may be produced directly.

In systems such as shown in the Griggs patents above, circulating a fluid in a closed system at a select high speed and passing through a narrowing channel, the fluid is suddenly introduced into an expanding section (cavitation bores) and the necessary decompression to create cavitations occur.

Cavitation is generally a detrimental phenomenon due to it's destructive characteristics, excessive heat generation, high discharge pressure, and noise. However, the invention is based on the realization that an improved cavitational apparatus can be made by installing a constriction or interference between a rotating cavitational body and the internal surface of a housing containing the body and, optionally, the internal surface of the rotating cavitational body and a secondary and stationary rotor head. In this case, it is ensured that the vacuum bubbles are continuously exploded. By designing the internal of the housing with the interference or constriction, the liquid to be heated surrounds the vacuum bubbles in the bores upon explosion, cavitational noise can be reduced, and the harmful effects of cavitation can be reduced or eliminated.

The invention, in one aspect is a cavitation apparatus producing heated purified liquids, containing at least one engine, a housing, the liquid to be heated, a rotating cavitation body rotating in the liquid to be heated and driven by the engine. The engine may be an electric engine, but steam or internal combustion engines, or the rotating shafts of turbines may also be used to drive the cavitation equipment. A stationary rotor head can be placed inside of the rotating cavitation body to form the second liquid heating zone. The invention also includes the method for the operation of the apparatus, which entails broadly supply a fluid, for example water to the apparatus for cavitation purposes and subsequent use of the heated fluid as would be known in the art. While water is a desired fluid, the apparatus can be used to heat and purify any fluid if so desired.

The advantages of the invention are amplified by having cavitation bores in the rotating cavitational body and the rotor head, if present. For the rotating cavitational body, its external surface is fined with cavitational bores, much like found in the Griggs patents. The bores and the chamber between the rotating cavitational body and the surrounding housing forms a cavitational flow zone. In the embodiment using the stationary rotor head, the external surface of the rotor head is also fitted with cavitation bores so as to face an inner surface of the rotating cavitational body, which is then generally ring-shaped. This creates an additional liquid cavitational flow zone between the inside of the rotating cavitational body and the rotor head to enhance the cavitation of the fluid.

Figure 3:
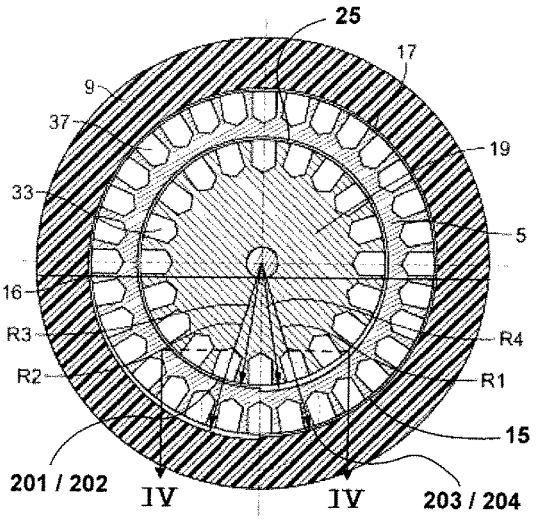
FIG. 3 shows a sectional view along the line III of FIG. 2.
Figure 4:
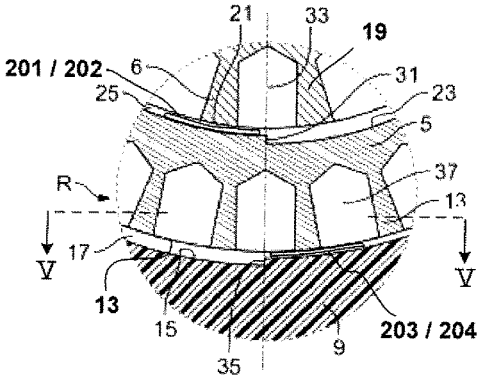
FIG. 4 shows an enlarged portion of the sectional view in FIG. 3.
Figure 5:
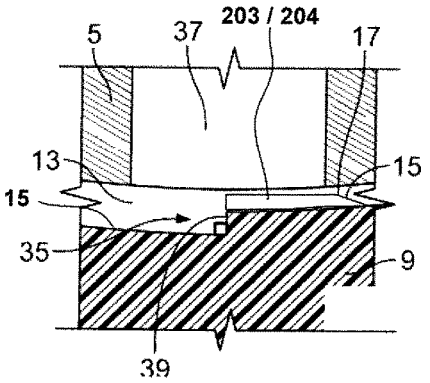
FIG. 5 shows an even more enlarged view of a portion of FIG. 4.
Figure 6:
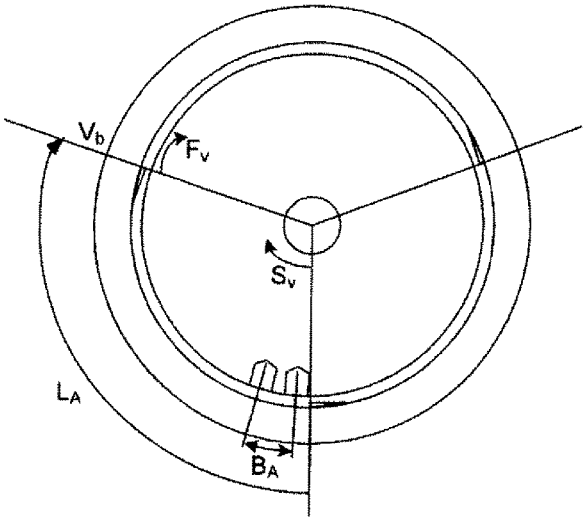
FIG. 6 shows discharge locations, and cavitation bore locations with respect to motor speed and calculated fluid velocity at discharge in a standard two dimensional fashion.
Figure 7:
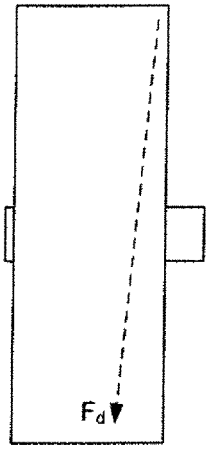
FIG. 7 shows a typical cylindrical fluid path within a cavitation head in the third dimension.

One embodiment of the invention is shown in the FIGS. 1-10. The apparatus is designated by the reference numeral 10 and includes an external motor 1 is used to rotate a rotating cavitational body or external rotor 5 through a direct drive shaft 3 that includes a shaft seal 7. The shaft 3 extends through an opening 6 in an end 8 of a housing 9 and an opening 12 in the external rotor 5. The external rotor 5 can be rotated at any number of speeds and this depends on the viscosity of the fluid being heated. Typical speeds are from 2500-4000 rpm to generate optimal cavitation of fluid, such speeds similar to those disclosed in the Griggs patents. However, to improve on Griggs patent, and to precisely locate, in the third dimension, the cavitation bubbles discharged to the cavitation bores 33, 37 the motor speed is tuned to the apparatus 10 by use of a variable speed controller 301 along with the directional and bounce bumpers. This is crucial to producing the exact shaft speed $S_v$, that determines horizontal $V_X$, vertical $V_Y$, and tertiary velocity $V_Z$ of the fluid at discharge zones 31, 35 of apparatus 10. The fluid is compressed within the discharge funnel, directed, and released at a specific velocity $F_V$ which is determined by the physical arc length $L_A$ between cavitation zones (FIG. 6) in determining the actual number of cavitation discharge zones with a given cavititation head at any particular motor speed. Since the velocity of the fluid $F_V$ can be tuned, a determination of the time a fluid molecule will take to travel along path $L_A$ can be made and the horizontal and vertical component of the fluid at discharge zones 31, 35 can be calculated. The curvilinear motion horizontal velocity is determined as a function, $V_x=d_x/d_t$, while the vertical velocity is $V_y$ $d_y/d_t$ and tertiary velocity is $V_Z=d_Z/d_t$. The directional and bounce bumpers are designed to drive the tertiary velocity $V_z$ to zero, by eliminating the $d_Z$ component and thus by solving for $d_x$ and $d_y$, the location of the cavitation bores 33, 37 and the distance between the bores $B_A$ with respect to time (i.e. motor speed) for tuning can be determined. FIG. 6 only depicts two cavitation bores but it should be understood that the cavitation bores would extend along the circumference of the external rotor as shown in FIG. 3.

A rotor housing 9 is provided that has no internal bearings. The existence of internal bearings is a critical failure mode of the Fabian patent as in this design, the bearings would be directly affected by thermal transfer of fluid to bearings during the cavitation process. Accordingly, the shaft 3 of the motor 1 extends through the housing 9 and supports the external rotor 5 for rotation in a cantilevered configuration. The motor has a longer shaft 3 than normal and internal bearings in the motor to support the balanced external rotor 5 when the shaft 3 extends through housing 9. The housing 9 forms a cavity 11, with the cavity shaped to receive the external rotor 5. A conventional shaft seal (not shown) is positioned between the motor shaft 3 and the housing 9 for sealing purposes. With the cantilevered arrangement of the motor shaft and the bearings being associated with the motor for shaft support, the problems with bearing failure in the prior art devices is eliminated.

In operation, fluid, e.g., water, is introduced into the cavity 11 at a rate based upon optimal tuned speed of motor for the fluid during operation of the apparatus 10. When the external rotor 5 is positioned within the housing, an outer surface 13 of the external rotor 5 faces an inner surface 15 of the housing 9. A gap 17 exists between these two surface 13 and 15, and this gap 17 becomes one fluid heating zone for the apparatus 10, consisting of three lateral cavitation zones 215.

In the embodiment of FIGS. 1-10, six fluid heating zones exist by reason of three sets of three discharge zones 31 and 35 for heating zone 17 and the same arrangement for heating zone 25, so that there are a total of eighteen cavitation zones 215. This number can be increased or decreased by varying the size of the cavitation head for additional arc length $L_A$ consistent with the motor speeds selected. This is accomplished by providing a secondary rotor head 19 in a specific rotational pitch or configuration and has similar physical characteristics as the external rotor 5 to enhance the energy in the fluid. An outer surface 21 of the rotor head 19 faces an inner surface 23 of the external rotor 5, with a gap existing therebetween. The gap forms another fluid heating zone 25 of the apparatus 10.

A housing cover 27 is also provided. The housing cover 27 mates with the housing 9 using any known fastening technique to form a sealed cavitation chamber that includes the rotor head 19 and the external rotor 5. The rotor head 19 is mounted to the housing cover 27 in any conventional way to create the gap 25 as the second fluid heating zone between the external or outer surface 21 of the rotor head 19 and the inner surface 23 of the external rotor 5. As an example of the mounting, openings 26 can be used with the appropriate fasteners.

The materials selected for the external rotor 5 and rotor head 19, and housing 9 and cover 27 are selected for optimal performance and safety. Examples of materials for the housing 9 and cover 27 include polymers, e.g., a polyamide. The external rotor 5 and rotor head 19 can be made from metal materials like aluminum or an alloy thereof or stainless steels.

The fluid to be heated or purified is introduced to the cavitation apparatus 10 through an intake port 29 located on the housing cover 27. While the position of the intake port 29 can vary, it is preferred to be positioned so that fluid entering the second fluid heating zone 25, see FIG. 4, that is between the fixed internal rotor head 19 and the external rotor 5.

Figure 8:
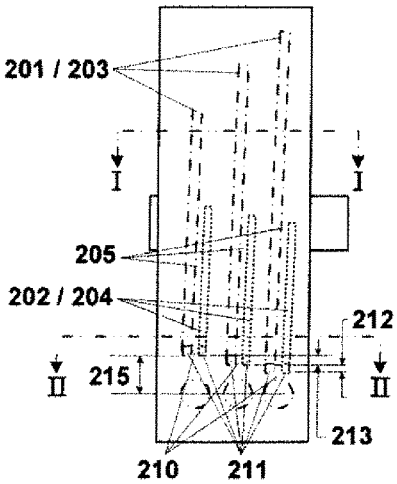
FIG. 8 shows general locations of bumpers with respect to each other to provide for uniform discharge velocity of fluid to cavitation bores in the third dimension.
Figure 8A:
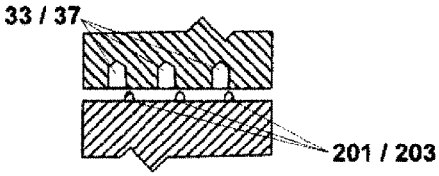
FIG. 8A shows a cross section of FIG. 8 at the entry point of discharge funnels.
Figure 8B:
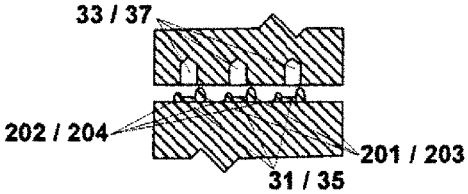
FIG. 8B shows a cross section of FIG. 8 towards the discharge funnels.
Figure 10:
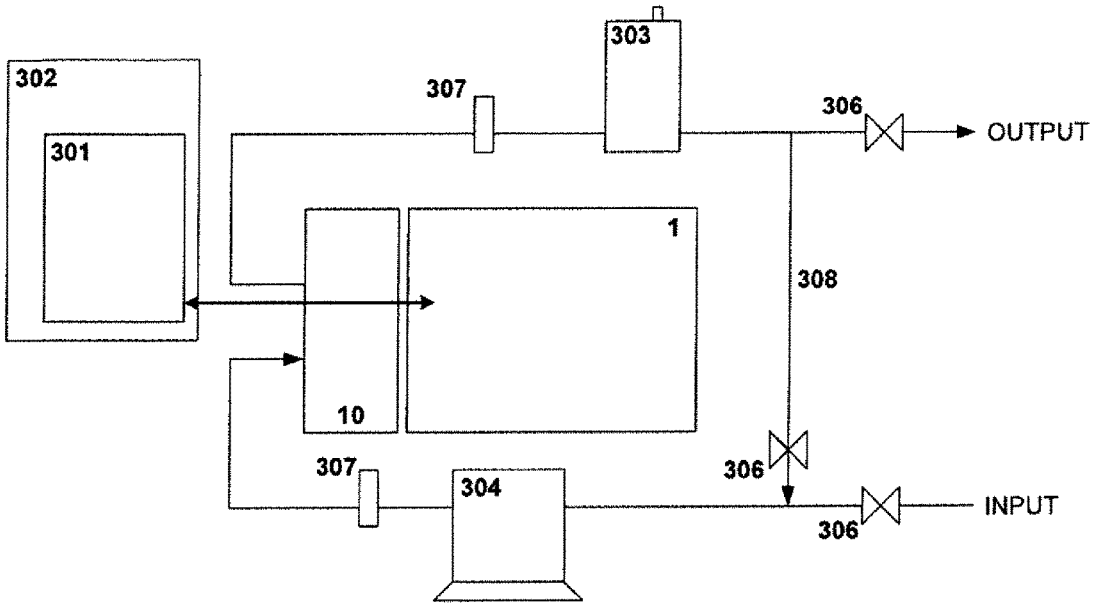
FIG. 10 shows overall system requirements to produce a controlled three dimensional cavitation process without negative destructive forces.

The cavitation zones 17 and 25 have special characteristics that allow for optimal cavitation to occur. FIG. 8 shows the location of these characteristics. Inner surface 15 of rotor housing 9, and inner surface 23 of external rotor 5 have directional bumpers 201 and 203, and bounce bumpers 202 and 204, respectively, to channel the water on the direction path to ramp section 31 and 35 in each of these. The directional bumpers 201 and 203 of these surfaces are longer, while the bounce bumpers 202 and 204 are shorter in length and allow the water to be channeled to the ramp zone 31 and 35, along the natural fluid direction $F_d$ as depicted in the tertiary view of FIG. 7. Each set of these bumpers is offset with the inner series to midrange series being offset 212, while the midrange series to outer series offset 213 to accommodate the variation of time for fluid molecule to travel in a cylindrical motion, and thus effect the cavitation zone velocity components $V_X$, $V_Y$, and $V_Z$ in determining cavitation bore 33 and 37 locations. This allows the internal rotor 21 and external rotor 5 to be consistent with standard manufacturing processes.

Additionally, allowing the discharged fluid path to be three dimensional presents geometric manufacturing issues with locating and forming the cavitational bores 33 and 37, a perpendicular section 210 of directional bumpers 201 and 203 and bounce bumpers 202 and 204 to facilitate a two dimensional discharge of fluids to the cavitation bores 33 and 37 is provided. The cavitation bores 33 and 37 are located in the two dimensional plane, because the tertiary velocity $V_Z$ has been driven to zero, such that distance between discharge zone 215 and cavitation bores 33, 37 is in direct correlation to speed of fluid $F_v$. By precisely locating the discharge fluid to the alignment of the cavitation bores 33 and 37, the destructive cavitation bubbles are prevented from being released uncontrollably in sections without cavitation bores. This is accomplished by the shape of the inner surface 23 of the external rotor 5 in the funnel zones 205 between directional bumpers 201 and bounce bumpers 202. This ramped surface has a spiral shape, which is illustrated by radial distances, as measured from a central and longitudinal axis A of the apparatus 10. Referring to FIG. 3, one radius R3 as measured from a center axial point of the apparatus is such that the radius R3 is less than another radius R4. This difference in radius and spiral shape of the inner surface 23 of the external rotor 5 creates a wave ramp 31. This configuration produces a pressure differential critical for formation of cavitation vacuum bubbles at wave ramp 31.

The rotor head outer surface 21 is configured with a number of spaced apart cavitation bores 33 of a given depth and circumference. The bores 33 cooperate with the wave ramp 31 and spiral shape of the inner surface 23 of the external rotor 5 to create a continuous and growing vacuum bubble generation in the regular arrangement of the cavitation bores 33 of the rotor head 19. Heat is generated through the cavitation process of the fluid with virtually no destructive impact to the rotor head 19 or the cavitation bores 33. During operation, the external rotor 5 is spinning in a clockwise direction, see FIG. 4. The fluid is compressed during the rotation cycle of the external rotor 5 and pressure increases in the fluid cavitation zone 25 and 17. The entry to the wave ramps 31 and 35 provides an area of expansion that generates a rapid loss of pressure and this pressure reduction permites the forming of the cavitation bubbles and subsequent explosion in the cavitation bores 33 and 37.

After entering the zone 25, the fluid exits the zone 25 through multiple ports 34 at the rear face 36 of the external rotor 5. This exiting fluid then enters the other fluid cavitation zone 17 formed in the space between the inside surface 15 of the housing 1 and the outer surface 13 of the external rotor 5. In effect, the fluid is introduced to a secondary cavitation process, which is opposite in direction from a spinning fluid flow direction to the first cavitation process occurring in the zone 25 between the rotor head outer surface 21 and the inner surface 23 of the external rotor 5.

The housing 1 is equipped with the similar spiral configuration on the inner surface 15 thereof with a corresponding wave ramp 35 formed by the radial differences shown in FIG. 3. That is, the radius R1 is less than radius R3 so as to form the wave ramp 35 in the funnel zones 205 between directional bumpers 203 and bounce bumpers 204.

The external rotor 5 includes cavitation bores 37, like those in the rotor head 19.

Fluid exiting the first heating zone 25 is introduced into the second heating or cavitation zone 17. The spinning fluid therein is then introduced into the regular arrangement of external rotor cavitation bores 37 in the same fashion as fluid is introduced into the bores 33 in the rotor head 19. What is different between chambers 17 and 25 is the orientation of the wave ramps 31 and 35. The wave ramp 35 is configured oppositely from the wave ramp 31

Put another way and referring to FIG. 3, the spiral of increasing radius moves in the clockwise direction for surface 23 of the external rotor 5, short radius R3 to longer radius R4. For surface 15 of the housing 9, the increasing radius moves in the counterclockwise direct, short radius R1 to longer radius R2. This means that the faces of the wave ramps 31 and 35 are opposite to each other. Referring to FIG. 5, the wave ramp 35 has face 39, which is shown with a right angle configuration. However, the face 39 could be angled as well. The spiral configuration insures the maximum vacuum bubble generation and the resulting heat generation bubble explosion. The dual balanced cavitation process of the zone 17 and zone 25 occur simultaneously. Thus, through a single rotational cycle of the motor and external rotor 5, the fluid is processed twice for cavitation.

It is also desirable for the cavitaton heating process that the primary wave ramps 31 and 35 be aligned at rest as shown in FIG. 3. That is, the wave ramps 31 and 35 are at the 6 o'clock position. Since the housing 1 is fixed and the apparatus would be positioned so that the axis A is horizontal, it is not a problem to have the wave ramp 35 in this position. In order to have the wave ramp 31 of the external rotor 5, which can move due to its motor connection in this position, one way is to have the external rotor 5 balanced by the multiple outlet ports 34 such that the when motor 1 is not providing power, the external rotor 5 returns to the proper start up position in respect to the inner wave ramp 31 and the outer wave ramp 35. With this start up position, maximum heat generation of the fluid within the process is achieved. While the wave ramp position of the external rotor could vary from the 6 o'clock position, even as high as 90 degrees to either side, cavitation efficiency is lowered when varying from the preferable start up position. It is also preferred that the wave ramps 31 and 35 be at the 6 o'clock position as this facilitates the start up of the apparatus from a priming standpoint (the input 29 is aligned with the wave ramp 31 since the apparatus not only functions as a liquid cavitation device but also like a pump, drawing liquid in to the apparatus 10 and discharging it. Varying from the 6 o'clock position towards either the 3 or the 9 o'clock reduces the pressure drop at the ramp and/or reduces the cavitation. By changing this configuration of the cavitation zones 215 to alternative positions such as the 3 or 9 o'clock positions, in conjunction with varying the arc length $L_A$, the cavitation device absorbed the heat of the fluid and produced a cooling effect, while maintaining the non-destructive nature of the caviation device.

The fluid being cavitated then leaves the cavitation apparatus 10 through an outlet port 41 in the cover 9 at low pressure (<1 atmosphere). In order achieve maximum efficency and eliminate the destructive element of cavitation, a total system should include the variable speed motor controller 301, a discharge water hammer tank 303, and an incoming storage tank 304 as a minimum. The discharge water hammer tank 303 is set to 12-15 psi which insure proper noise control of heating water, while the incoming storage tank 304 allows for the cavitation apparatus 10 to operate at ambiant fluid flow. Because each fluid's physical properties vary with respect to temperature rise, as indicated in the chart of FIG. 9 for water, it is important for the motor speed to be continually adjusted for speed control to insure cavitation process, specifically the distance for discharge zone 215 to cavitation bores 33, 37 is controlled. By tuning the motor speed to the physical characteristics of the fluid at any given temperature or other varient, it insures the distance to cavitation bores 33, 37 from funnel zones 205 is maintained for non-destructive cavitation. An additional control panel 302 will insure optimization of the cavitation process for the fluid under process by monitoring fluid temperature at probes 307 of intake and output of cavitation apparatus 10. Also, control valves 306 may be deployed with a crossover 308 to enhance system performance for certain applications such as purification. The heated fluid can be used in any known application that employs a heated fluid.

The invention is based on the realization that the objective of having a cavitation fluid heating apparatus without the known problems in prior art cavitation heating apparatus can be obtained by having a constricting form or interference in the zones or chambers 17 and 25 containing the wave ramp 35, directional bumpers 203, and bounce bumpers 204 between the rotating external rotor outer surface 13 and the inner surface 15 of the housing 9 and same constriction or interference as wave ramp 31, directional bumpers 201, and bounce bumpers 202 between the rotor head outer surface 21 and the external rotor inner surface 23. By designing the internal surface 15 of the housing 1 and the internal surface 23 of the external rotor 5 this way, it can be continuously ensured that the vacuum bubbles explode. Ensuring by designing the spiral surfaces 15 and 23, directional bumpers 201 and 203, and bounce bumpers 202 and 204 that funnel the liquid to be heated surrounds the vacuum bubbles in the bores upon explosion, cavitational noise is reduced, as well as reducing or eliminating the other harmful effects of cavitation, e.g., erosion of component parts and the like.

In significant variation to the Fabian design, it should be understood that the two chamber or zone design of FIGS. 1-10 can be modified so that it is only a one chamber design and still function with all benefits with a single drive motor. Thus, the rotor head 6 could be made without the cavitation bores and act only as a conduit to feed liquid to the zone 17 between the housing 1 and the external rotor 5. In yet a further embodiment, the rotor head 6 could be eliminated so that only the external rotor 5 with its cavitation bores 37, the housing 9 with its specially configured inner surface 15, and the appropriate inlet and outlet ports would interact to heat the fluid. This adaption of the invention allows for multiple size application configurations, with various motor sizes adaptable to a cavitation apparatus 10 for energy efficiency specific to the desired application.

While a single chamber apparatus provides heated liquid without many of the cavitation-related problems of prior art devices, it is more advantageous to employ the embodiment of FIGS. 1-10, wherein the external rotor is installed with a fixed rotor head 19, the external surface of which is fitted with additional cavitational bores 33. Together this configuration, with the associated system components, allows the rotor pump to produce heat energy at a significant increased ratio of energy utilization to consumption, while overcoming the traditional problems of prior systems; such as sonic sound waves (noise), bearing failures, and high discharge pressure energy losses.

The present invention is directed at releasing heat energy for use in delivering a fluid for heating, or cooling systems, fluid purification and separation, and any fluid processing that require heat to complete progression. Moreover, the invention, releases the energy through a cavitation process using less power consumption then traditional boiler systems or furnaces and significantly improves the energy and installation cost of purification system with similar capabilities. The balanced internal fixed rotor 19, external rotor 5, wave ramps 31 and 35, directional bumpers 201 and 203, and bounce bumpers 202 and 204, and coinciding housing 1 and cover 27 provide the unique physical characteristics to produce heat at an increased rate of return of energy consumption while maintaining thermal characteristics.

The present invention comprises these unique component characteristics in a manner such that the fluid that the heat generated is retained for extended periods of time and thus requires lower cycles of energy consumption.

The present invention is unique such that the multistage cavitation process is initially completed through a primary cavitation rotor head that is stationary, with the external rotor acting as both a centrifugal source for the initial process and a cavitation element of the second stage. Both the external rotor and rotor housing have wave ramps to enhance the cavitation process. This allows the system to maximize the energy released from the cavitation process, while maintaining a low discharge pressure in so that energy is not lost by changing the state of the fluid to a gas. The present invention configuration is such that the normally associated noise from the cavitation process is minimized and controlled.

As explained above, the spiral configuration of the surfaces 15 and 23 with the directional bumpers 201 and 203, and bounce bumpers 202 and 204 are an important feature of the invention. This configuration allows for the creation and growth of the vacuum bubbles in the bores 33 and 37. In the bores 33 and 37, the vacuum bubbles are created among the molecules and surrounded by the fluid to be heated. The bubbles do not actually explode but crash, when they reach the cavitation bores 33 and 37.

According to the method, the external rotor 5 is placed into the housing 1 and is rotated with the driving engine 1. During rotation, fluid to be heated is injected into the housing 1 through the input 29. With the help of the rotation, continuously growing vacuum bubbles are created among the liquid molecules in the bores 33 of the rotor head 6, if present, and in the bores 37 of the external rotor 5. Once the vacuum bubble reaches the cavitation step 31 or 35, they crash. The fluid to be heated is otherwise continuously flowed through the chambers 25 and 17, with the vacuum bubbles crashing in the expanding liquid after passing through the funnel zones 205. Upon the crash, the liquid molecules, moving in opposite directions, explode. The heat generated during the explosion is absorbed by the surrounding liquid, and the heated liquid is ultimately extracted through the output 41.

It is the advantage of the cavitation apparatus according to the invention to successfully eliminate or reduce the harmful effects of the cavitation phenomenon by using flow channels designed for the liquid to be heated and by using the procedure for the operation of the equipment.

Turning back to the embodiments discussed above, one embodiment of the invention uses a single rotating cavitation body having bores in it, with the bores open to an outer surface of the cavitation body. This cavitation body rotates within a housing and interacts with the cavitation step, which is located on the inside surface of the housing. During this rotation, vacuum bubbles are created in the bores in the rotating body. The bubbles eventually grow such that they are no longer confined to the bores and crash into the cavitation step. This crash causes the liquid molecules to explode, which is the energy release that causes the heating of the water.

In another embodiment, there are two sets of bores, one on the outer surface of the rotating body and another set of bores on the outer surface of a second and stationary component located within the rotating body. In this dual bore embodiment, the cavitation step or wave form for the bores on the outer surface of the rotating body is on the inner surface of the housing. The cavitation step for the bores on the outer surface of the stationary rotor head are on the inner surface of the rotating body.

The inventive system configuration allows the cavitation apparatus to produce heat energy at a significant increased ratio of energy utilization to consumption, while overcoming the traditional problems of prior systems; such as sonic sound waves (noise), bearing failures, and high discharge pressure energy losses. The system consisting of control panel 302, variable speed motor controller 301, a discharge water hammer lank 303, incoming storage tank 304 and control valves 306 with crossover 308 enhance the capabilities of the cavitation apparatus 10.

The present invention, through mechanic means, produces heated water at a 30-70% decreased rate of energy consumption (dependent upon the volume of fluid in the system) through a balanced cavitation furnace.

Another aspect of the invention is the ability of the apparatus to increase the density of the fluid being heated, e.g., water. Since it is known that less energy is needed to heat denser water, the increase in density of the water helps in increasing the efficiency of the fluid heating process.

Testing has been performed to monitor the heating effect of the inventive apparatus. This testing involved running the cavitation apparatus using different volumes of water to be heated and monitoring inlet water temperature, the volume of water flow rate, outlet water temperature of the cavitation apparatus, the temperature of the supply water to the apparatus, power of drive motor, electricity consumption, values of power, consumption of electricity power, and ambient temperature. This testing showed high efficiencies in terms of amount of heating done to the water as compared to the power used to run the apparatus.

As such, an invention has been disclosed in terms of preferred embodiments thereof which fulfills each and every one of the objects of the present invention as set forth above and provides a new and improved fluid heating apparatus using cavitation.

Of course, various changes, modifications and alterations from the teachings of the present invention may be contemplated by those skilled in the art without departing from the intended spirit and scope thereof. It is intended that the present invention only be limited by the terms of the appended claim.

We claim:

1. An apparatus for heating a fluid using cavitation comprising:

a housing having an inlet for fluid to be heated and an outlet to discharge the heated fluid from the housing;

an external rotor adapted to be fixed on a motor shaft extending in a axial direction, the external rotor contained in the housing and adapted to rotate within the housing, the external rotor having a plurality of cavitation bores arranged in an outer surface thereof and the external rotor arranged within the housing to form a fluid heating zone between the outer surface of the external rotor and an inner surface of the housing that faces the outer surface of the external rotor, the inner surface of the housing extending in the axial direction and a housing circumferential direction, wherein the inner surface of the housing facing the bore-containing outer surface of the external rotor has a plurality of first funnel zones extending along the inner surface of the housing and in the housing circumferential direction, the plurality of first funnel zones laterally spaced apart from each other in the axial direction, each first funnel zone terminating in a first discharge zone, each first funnel zone including a first ramp, each first discharge zone offset in the housing circumferential direction from an adjacent first discharge zone, fluid entering the housing being heated by interaction with the first funnel zones and first ramps, bores in the external rotor, and external rotor rotation.

2. The apparatus of claim 1, further comprising a stationary head, the stationary head mounted in the housing and having an outer surface which faces an inner surface of the external rotor, the inner surface of the external rotor extending in the axial direction and an external rotor circumferential direction, the outer surface of the stationary head and the inner surface of the external rotor forming a second fluid cavitation zone, the outer surface of the stationary head including a plurality of cavitation bores therein, the inner surface of the external rotor having plurality of second funnel zones extending along the inner surface of the external rotor and in the external rotor circumferential direction, the plurality of second funnel zones laterally spaced apart from each other in the axial direction, each second funnel zone terminating in a second discharge zone, each second funnel zone including a second ramp, each second discharge zone offset in the external rotor circumferential direction from an adjacent second discharge zone, fluid entering the second fluid cavitation zone being heated by interaction with the second funnel zones and second ramps, bores in the rotor head, and external rotor rotation.

3. The apparatus of claim 1, wherein the cavitation apparatus has a horizontal longitudinal axis and each of the first discharge zones when viewed in a cross section transverse to the horizontal longitudinal axis is at a 6 o'clock position for heating fluid, and either 3 or 9 o'clock position for cooling of fluid.

4. The apparatus of claim 2, wherein the cavitation apparatus has a horizontal longitudinal axis and each of the first and second discharge zones when viewed in a cross section transverse to the horizontal longitudinal axis is at a 6 o'clock position for heating fluid, and either 3 or 9 o'clock position for cooling of fluid.

5. The apparatus of claim 1, wherein the first funnel zone at the first discharge zone on the inner surface of the housing has a face formed at a right angle with respect to the inner surface.

6. The apparatus of claim 2, wherein each of the first funnel zones at each of the first discharge zones on the inner surface of the housing has a face formed at a right angle with respect to the inner surface of the housing and each of the second funnel zones at each of the second discharge zones on the inner surface of the external rotor has a face formed at a right angle with respect to the inner surface of the external rotor.

7. A cavitation apparatus system comprising:

a) the apparatus of claim 1, b) an incoming water tank in communication with the inlet to the housing, c) a discharge water hammer tank in communication with the outlet of the housing, d) a motor having a motor shaft, the external rotor mounted to the motor shaft, e) a motor controller for controlling the speed of the motor, f) temperature gauges to monitor incoming and outgoing fluid for the apparatus, and g) a crossover pipe between an inlet to the incoming water tank and an outlet to the discharge water hammer tank.

8. The system of claim 7, wherein the external rotor is mounted to the motor shaft in a cantilevered configuration so that there are no internal bearings in the apparatus.

9. A method of thermally changing a fluid using cavitation comprising the steps:

a) providing the apparatus of claim 1, b) introducing fluid into the inlet, e) rotating the external rotor to heat the fluid using a controlled speed in order to improve alignment of bubbles with cavitation bores, and d) discharging the thermally changed fluid from the outlet.

10. The method of claim 6, wherein the fluid is water.

11. A method of thermally changing a fluid using cavitation comprising the steps:

a) providing the apparatus of claim 2, b) introducing fluid into the inlet, c) rotating the external rotor to heat the fluid using a controlled speed in order to improve alignment of bubbles with cavitation bores, and d) discharging the thermally changed fluid from the outlet.

12. The method of claim 11, wherein the fluid is water.

13. The method of claim 9, wherein the fluid is purified.

14. The method of claim 11, wherein the fluid is purified.

15. The apparatus of claim 5, wherein each of the first discharge zones when viewed in the cross section transverse to the horizontal longitudinal axis is at either 3 or 9 o'clock position for cooling of fluid.

16. The apparatus of claim 6, wherein each of the first discharge zones when viewed in the cross section transverse to the horizontal longitudinal axis is at either 3 or 9 o'clock position for cooling of fluid.

* * * * *